US006134928A

United States Patent [19]

Kang

[11] Patent Number: 6,134,928

[45] Date of Patent: Oct. 24, 2000

[54] METHOD AND APPARATUS FOR DECODING LOCK CYLINDERS

[76] Inventor: Samuel Kang, 863 Hyun Nae Ri Ha Bin Myun Dal Sung Goon, Taegu, Rep. of Korea

[21] Appl. No.: 09/150,711

[22] Filed: Sep. 10, 1998

[51] Int. Cl.[7] ..... E05B 19/20

[52] U.S. Cl. ..... 70/394; 70/395; 33/540

[58] Field of Search ..... 33/539, 540; 81/15.9; 70/394–395, 397, 399, 398

[56] References Cited

U.S. PATENT DOCUMENTS

| | | | |
|---|---|---|---|
| 347,170 | 8/1886 | Gere | 70/395 |
| 1,991,151 | 2/1935 | Hansen | 33/540 |
| 2,066,645 | 1/1937 | Rial | 33/540 |
| 2,087,423 | 7/1937 | Abrams | 33/540 |
| 2,257,054 | 9/1941 | Hoffman | 33/540 |
| 2,720,032 | 10/1955 | Harwell | 70/394 |
| 2,727,312 | 12/1955 | Tamke | 33/540 |
| 2,791,840 | 5/1957 | Harwell | 70/394 |
| 3,087,050 | 4/1963 | Rubens . | |
| 3,827,151 | 8/1974 | Naill | 70/394 |
| 4,186,577 | 2/1980 | Jarm | 70/394 |
| 4,667,494 | 5/1987 | Joosten . | |
| 4,680,870 | 7/1987 | McConnell . | |
| 5,133,202 | 7/1992 | Grant . | |
| 5,325,691 | 7/1994 | Embry . | |

FOREIGN PATENT DOCUMENTS

| | | | |
|---|---|---|---|
| 2389739 | 1/1979 | France | 70/394 |

*Primary Examiner*—Darnell Boucher
*Attorney, Agent, or Firm*—Frank J. Bonini, Jr.; John F. A. Earley; Harding, Earley, Follmer & Frailey

[57] ABSTRACT

A method and apparatus for decoding locks having a guide member, an alignment member, a reader, and a recording medium, which a guide member is inserted into a lock to open the lock to receive an alignment member which aligns the tumbler members of a lock, thereby permitting a reader to be inserted into the lock, and withdrawn therefrom to cause a displacement of a pivotally connected reader arm which records an image of the lock profile on a recording medium.

13 Claims, 15 Drawing Sheets

METHOD AND APPARATUS FOR DECODING LOCK CYLINDERS

BACKGROUND OF HE INVENTION

1. Field of the Invention

This invention relates to the field of lock decoding, and more particularly to an apparatus and method for decoding cylinder type locks by determining the profile of a key, without first unlocking the lock, or otherwise destroying or opening the lock.

2. Brief Description of the Prior Art

Locks using key operated systems are widely available and known. Key locking systems, for example, are used in automobiles, homes, offices and industrial buildings, cabinets and other applications and locations requiring limited or restricted access thereto. Often, keys are used to lock important or critical items, such as the aforementioned vehicles, homes, etc. In many instances, keys, which must be carried separately from the lock with which they are to be associated and used, are prone to becoming misplaced, lost and even stolen. A key which is not readily available for use, such as a lost or misplaced key, creates complications for the lock user. While many individuals will have a duplicate or spare key, it sometimes will not be in their possession or readily available. In other instances, there may be no spare keys. Most commonly, among those keys which are misplaced are included automobile keys, and house keys. In the case of automobile keys, for example, it is often not enough to simply have a locksmith open a car door, since one will need to start the car engine in order for the vehicle to be used. To do this a key must be made. For example, where people have lost keys on vacation, in the ocean or some other place where it is not likely to be recovered, not only must the individual be given access to his or her vehicle, but also, the person must have a key in order to start the vehicle. While many manufacturers provide a key code which enables the mailing of a duplicate key which will fit that specific vehicle, usually the automobile dealers, and not locksmiths, are the only ones with access to the codes and equipment required to make a key which will fit. While a locksmith can obtain access to the automobile, for example, by picking a door lock, generally, this provides little help to the vehicle owner or user who then wishes to drive the vehicle to another location.

While mention was made of certain key codes, car dealers are not open twenty-four hours a day, and sometimes are not close by, rendering it impossible to have a new key made. Today, there are more difficulties encountered by the use of high security vehicle locks. These keys are even more difficult to duplicate and require specialized equipment for their production. High security type keys often include two profiles, one on one side of the key, and another on the opposite side of the key. The profiles are often separated by a wall between them.

In many cases, the only way to make a new key, when one has been lost, is to read the lock. This requires that the lock be disassembled in order to ascertain the proper profile of the key which will fit the lock and open it. This is often an expensive and impractical procedure, since the lock must be removed from its mounting and disassembled. In the case of an automobile, the lock must be removed from the door panel. This is considerably expensive and time consuming. Other difficulties, apart from removal of the lock, include encountering locks which cannot be readily disassembled, but must be destroyed and replaced. Thus if the lock must be destroyed, it will often be useless, except in the case of automobiles, for example, the key is still needed to operate the engine.

Among the many lock types are cylinder locks, which themselves, comprise many varieties. Cylinder locks, for example, can include pin tumblers and wafer tumblers which must be placed into proper positions by a key which is inserted into the keyhole of the cylinder of the lock. When the tumblers are set by the key into their proper positions, the key can then be turned to therefore rotate the cylinder of the lock relative to the outer housing or casing. Generally, the proper key is needed to move each tumbler into a position where it does not interrupt the rotation of the lock cylinder. For example, insertion of the proper key, that is, one having the correct profile, causes the pin or wafer tumblers to move into a position in which each tumbler is located within a zone defined generally by the outer surface of the cylinder of the lock. When the profile of the key is not correct, then one or more of the tumblers will extend from the inner cylinder into a groove or retaining feature generally located in the surrounding casing or outer housing to prevent relative rotation of the cylinder, and thereby prevent unlocking of the lock.

In a wafer type cylinder lock, often the wafers are interchangeably provided so that the lock can be made to use a different key by resetting the position, number and type of wafers used. Generally, each wafer is cut to one of several sets of dimensions corresponding to a notch of a particular depth, to be located at a point along the shank of a key for such a lock which corresponds with the position in which that particular wafer tumbler is located within the cylinder of the lock. For example, any two or more different wafers might be in any particular wafer position of the cylinder. In order to decode the lock to ascertain the key profile, the positions of each wafer within the cylinder must be ascertained.

In the past, methods have been proposed for decoding locks without the need for disassembly or destruction of the lock. One method includes the use of a visual aid for inspecting the interior of the lock to observe the positions of the individual wafers or tumblers. For example, U.S. No. Pat. 3,087,050 discloses the use of a lamp and probe for holding some of the tumbler wafers out of the way of the line of sight in order to permit observation of other wafer positions. This method requires the accurate estimation of the tumbler positions within the lock based on the observer's visual inspection. Because of small variations in the locations of the tumbler positions, and because of reflections and shadows of light, ascertaining the correct key profile by this method can prove difficult.

Another example is a side bar lock mechanism of the wafer type, disclosed in U.S. Pat. No. 4,185,482, issued to William B. Nail, the complete disclosure of which is herein incorporated by reference. The '482 patent discloses a tool which allegedly can be used for determining the bitings or cuts of a key that will open side bar locks employing wafer type tumblers. The lock mechanism disclosed in the '494 patent shows 5 wafer type tumblers, while there may be six tumblers with spacing along a longitudinal axis of the lock mechanism, for example, in General Motors type vehicle locks. While professional locksmiths can have information on the type of lock and types and numbers of tumblers used, the position of each tumbler within the lock for opening is not readily available to locksmiths. The locksmith must have the identification number of the lock. This is often difficult to obtain, since many times, automobile dealers will not maintain records of after a certain period of time, or cars might be sold to different owners. Moreover, even though the lock identification number may be present on the casing of the lock mechanism, this requires removal of casings, and even the steering wheel in order to gain access. Furthermore, in the case where an individual has locked his or herself out of a vehicle, gaining access thereto, itself, might prove to be a difficult obstacle.

Prior approaches to open a side bar type lock, where a key has been lost, include drilling the lock cylinder so that a pin or wire can be inserted into the lock in a position to exert considerable radially inward pressure on the side bar. This causes the leading edge of the side bar to bear against the tumblers with more pressure than normal, so that when a locksmith manipulates each tumbler with a pick, it is easier to align the V-notches in the tumblers with the side bar so that the lock can be opened. Of course, the problem with this approach is that the lock is ruined by the drilling and must therefore be replaced. If, for example, the lock is that of an automobile door, then the time and expense to replace the lock can be considerable because the inside door paneling, the handles, and controls must be removed to gain access to the interior.

Another decoding device and method for decoding cylinder locks is disclosed in U.S. Pat. No. 4,680,870, the complete disclosure of which is herein incorporated by reference. This device incorporates a slide which requires the user to then take readings from the slide in order to determine the key profile.

A need exists for an inexpensive method of decoding a lock without the need to disassemble or break apart, or otherwise damage the lock mechanism. Such a method and device would save time and expenses and permit a lock key to be readily duplicated when needed.

SUMMARY OF THE INVENTION

The present invention provides a novel method and apparatus for decoding a lock to ascertain the proper key profile required for use in opening the lock, without having to remove the lock from its installation or disassemble the lock. A lock decoding apparatus including a guide, a reader, and a decoder is provided. An alignment element is also provided to align the position of the reader with respect to the guide member and to position the tumblers for reading of the corresponding key profile. A recording medium is disposed on the guide to record readings from the reader. Preferably, the recording medium is replaceable to permit reuse of the apparatus and transport of the recording. A decoder is provided for relating the reading on the recording medium to enable a key with the proper profile to be made.

The method of decoding a lock in accordance with the present invention includes sliding the lock's dust cover aside or out of the way to expose the interior of the lock cylinder and permit access thereto. An alignment member is then inserted into the lock cylinder to align the tumblers in order to clear the way for the insertion of the reader. The reader is then inserted into the lock cylinder and aligned with the guide member and alignment member. The reader is loaded with a recording member which corresponds with the recording medium of the guide member for transmission of a response from the reader. The alignment member is removed from the lock cylinder to permit the lock pins or wafers to return to their unlocked original positions. The reader is then slowly withdrawn from the lock cylinder, and a reader needle or arm deflected by the wafers or pins to cause to be recorded on the recording medium a profile of a key. A decoder is then used to decipher the recording. The reader can then be reversed, that is turned upside down, to read the profile of the opposite side of the lock to account for all of the pins or tumblers. This is done by repeating the steps of insertion of the guide member, and so forth.

It is an object of the present invention to provide a novel lock decoding apparatus and a method for decoding a lock to ascertain the profile of a key which can be used to open the lock.

A further object of the present invention is to provide a reusable decoding device for recording the profile of a key.

Another object of the present invention is to provide a lock decoding device which includes elements which attach to a panel in which a lock is installed to facilitate operation of the decoding device.

A further object of the present invention is to provide a decoding apparatus and method for decoding a lock which can be used in connection with locks utilizing high security type keys.

Another object of the present invention is to provide a decoding apparatus and method which is usable with tumblers having non-uniform thicknesses, or where the number of tumblers in a lock is not known.

BRIEF DESCRIPTION OF THE DRAWING FIGURES

Figure 2:
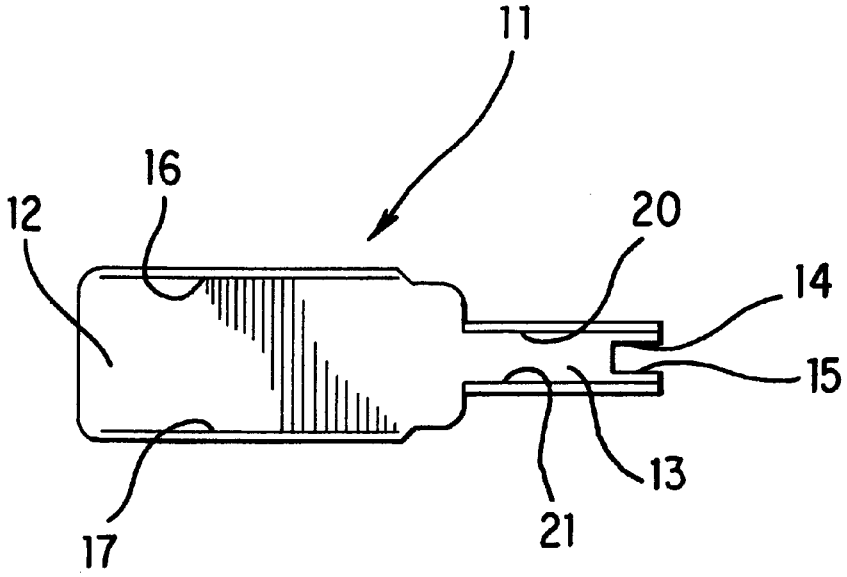
FIG.2 is a side elevation view of a guide member of the lock decoding device according to the present invention.
Figure 2A:
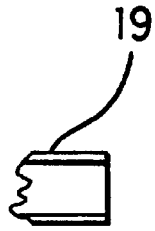

FIG. 2*a* is a side elevation partial view of an alternate embodiment of a guide member of the lock decoding device according to the present invention.

Figure 3:
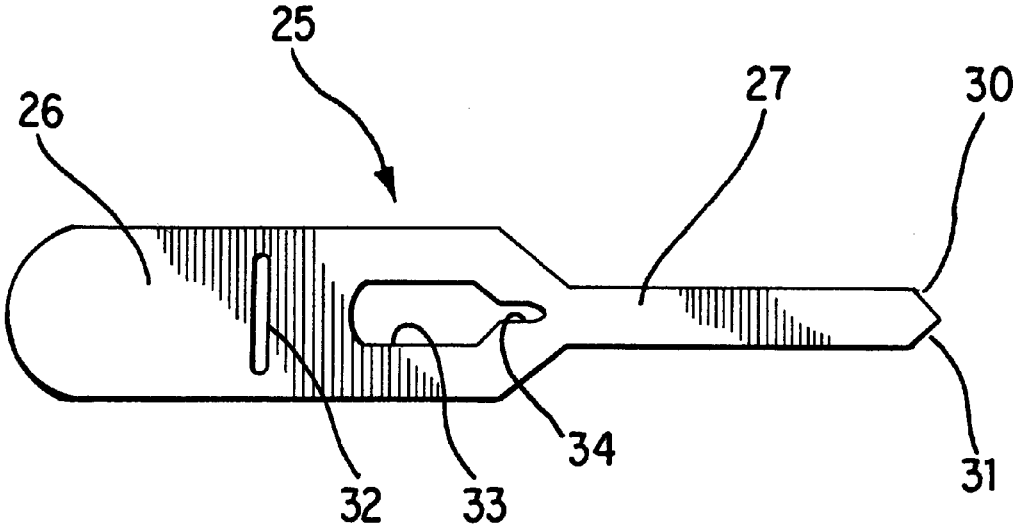

FIG. 3 is a side elevation view of an alignment member of the lock decoding device according to the present invention.

Figure 4:
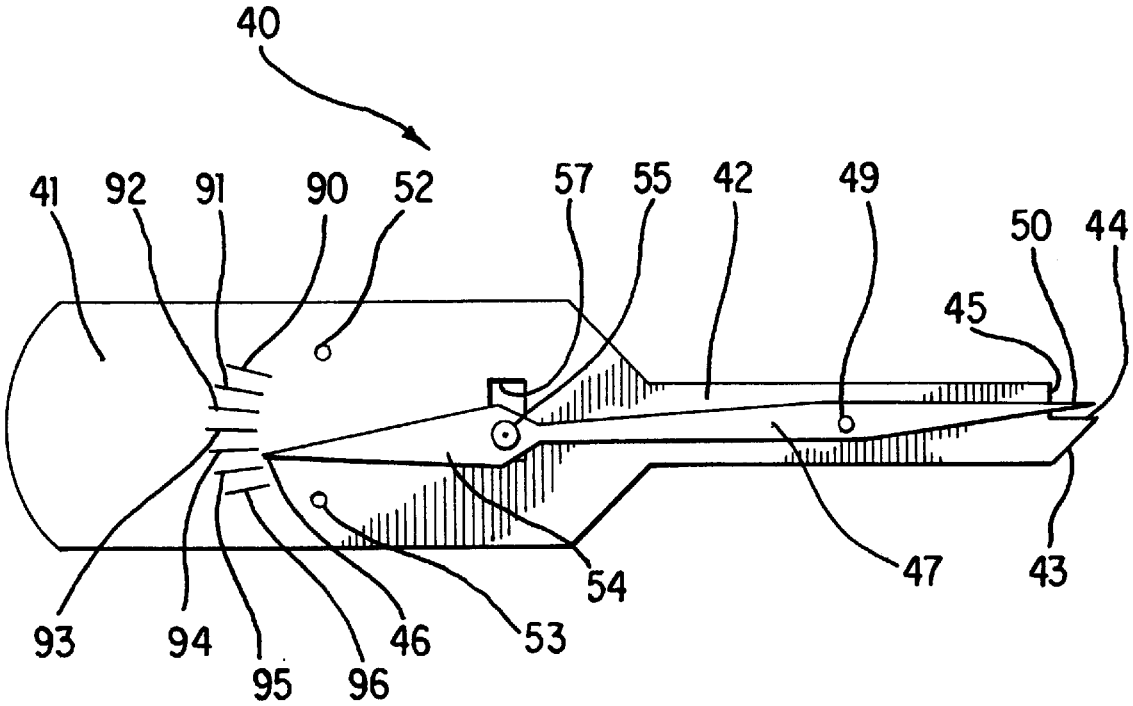

FIG. 4 is a side elevation view of a reader of the lock decoding device according to the present invention.

Figure 5:
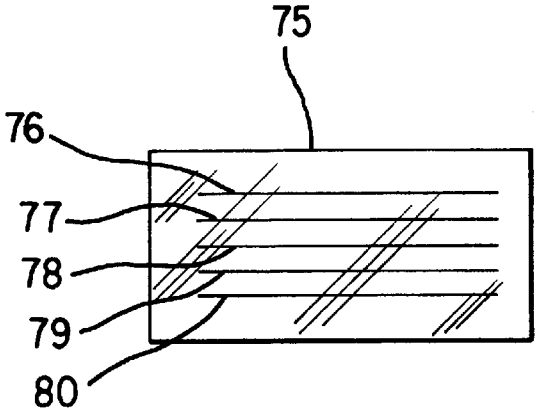

FIG. 5 is a front elevation view of a decoder of the lock decoding device according to the present invention.

Figure 5A:
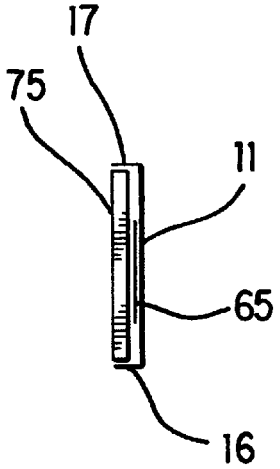

FIG. 5*a* is a side elevation view of the decoder positioned over a strip of paper on a guide member, as viewed from the rear of the guide member.

Figure 6:
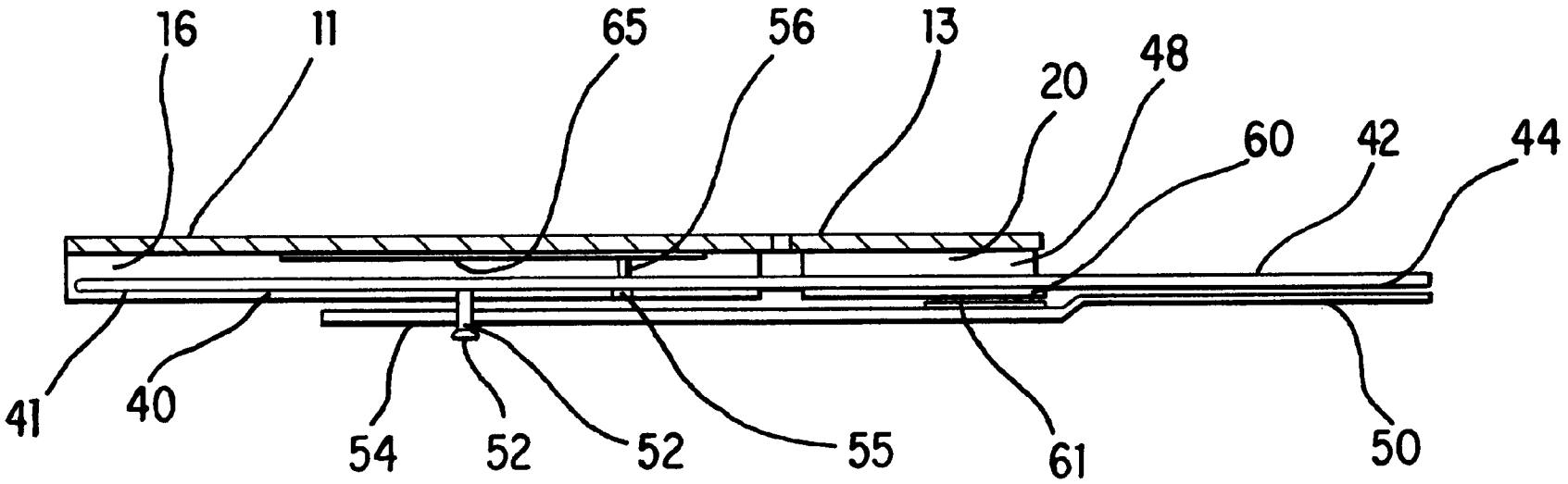

FIG. 6 is a top plan view of the guide member of FIG. 2 and reader shown in FIG. 4 together in a position for decoding a lock.

Figure 1:
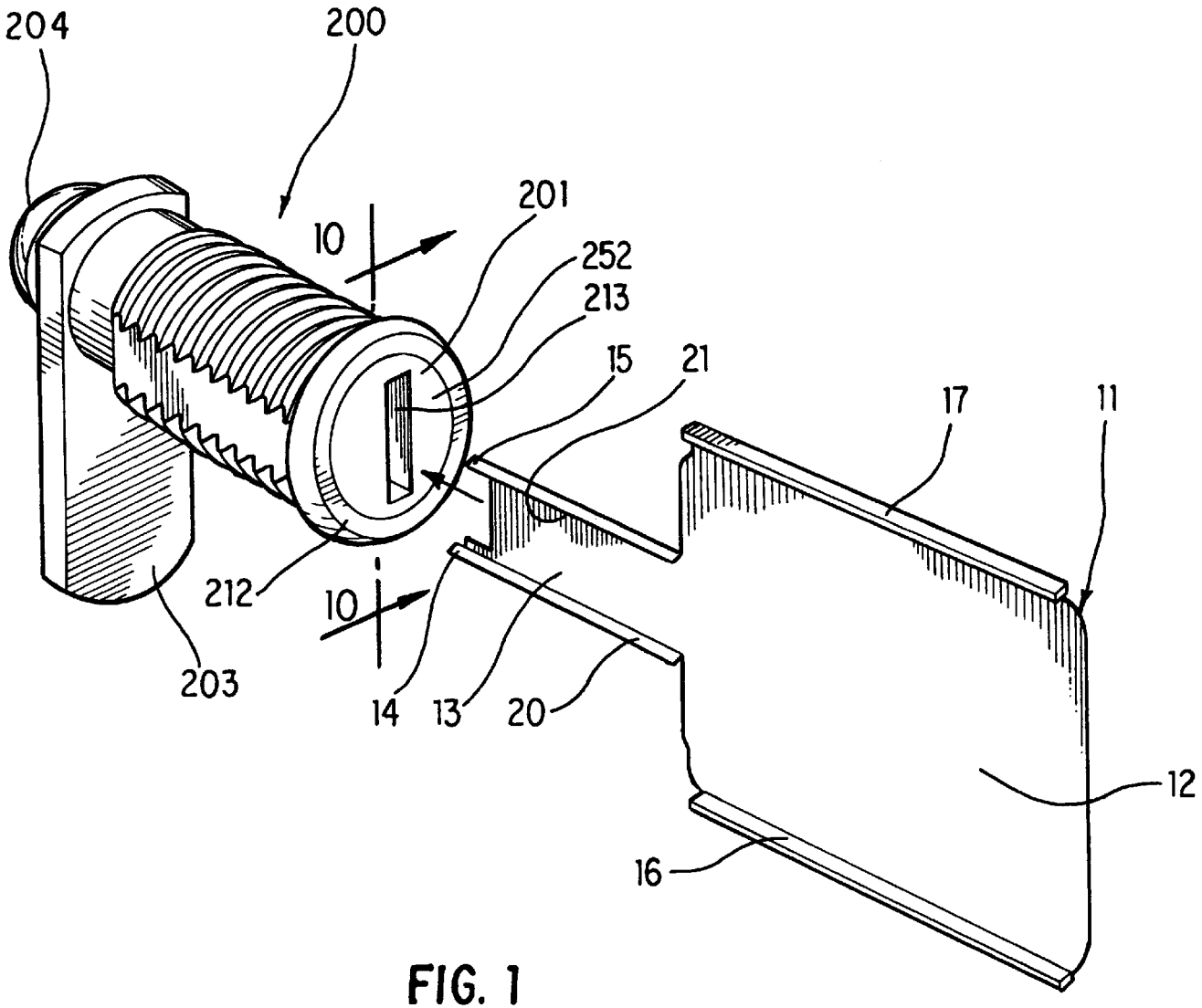
FIG. 1 is a parallel perspective view of a guide member of a lock decoding device according to the present invention, shown with a cylinder lock of a type with which the present invention can be used.
Figure 7:
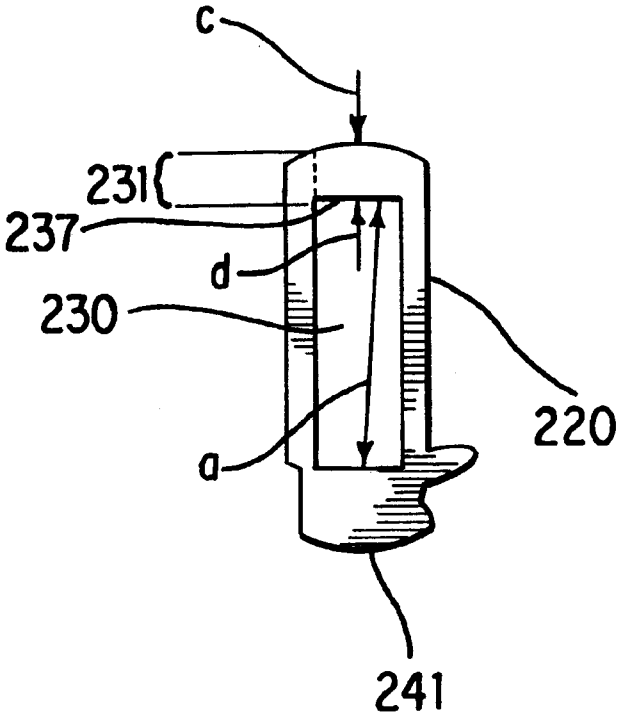

FIG. 7 is a front elevation view of an example of a tumbler member which can be used in the lock shown in FIG. 1.

Figure 8:
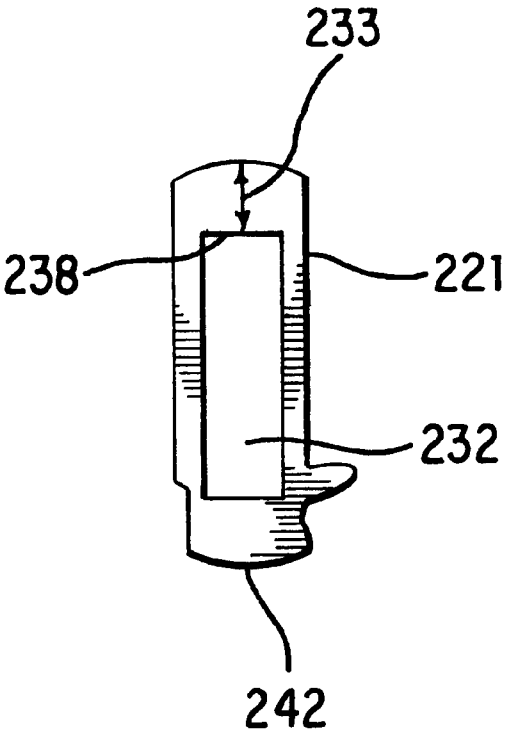

FIG. 8 is a front elevation view of an example of a tumbler member which can be used in the lock shown in FIG. 1.

Figure 9:
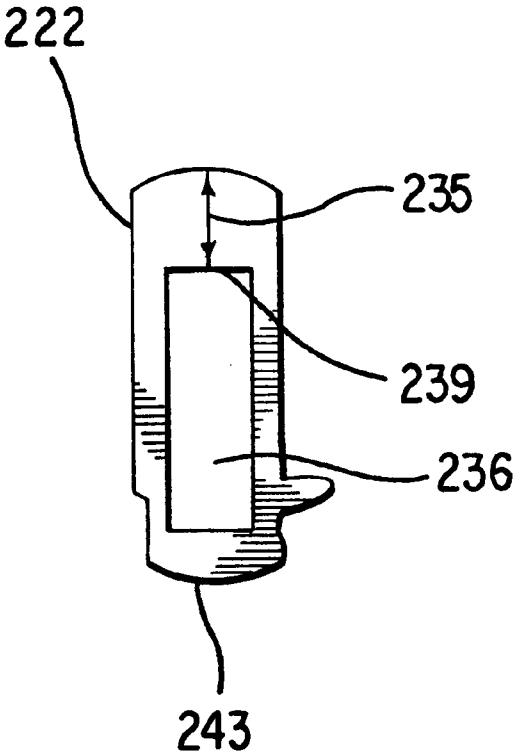

FIG. 9 is a front elevation view of an example of a tumbler member which can be used in the lock shown in FIG. 1.

Figure 10:
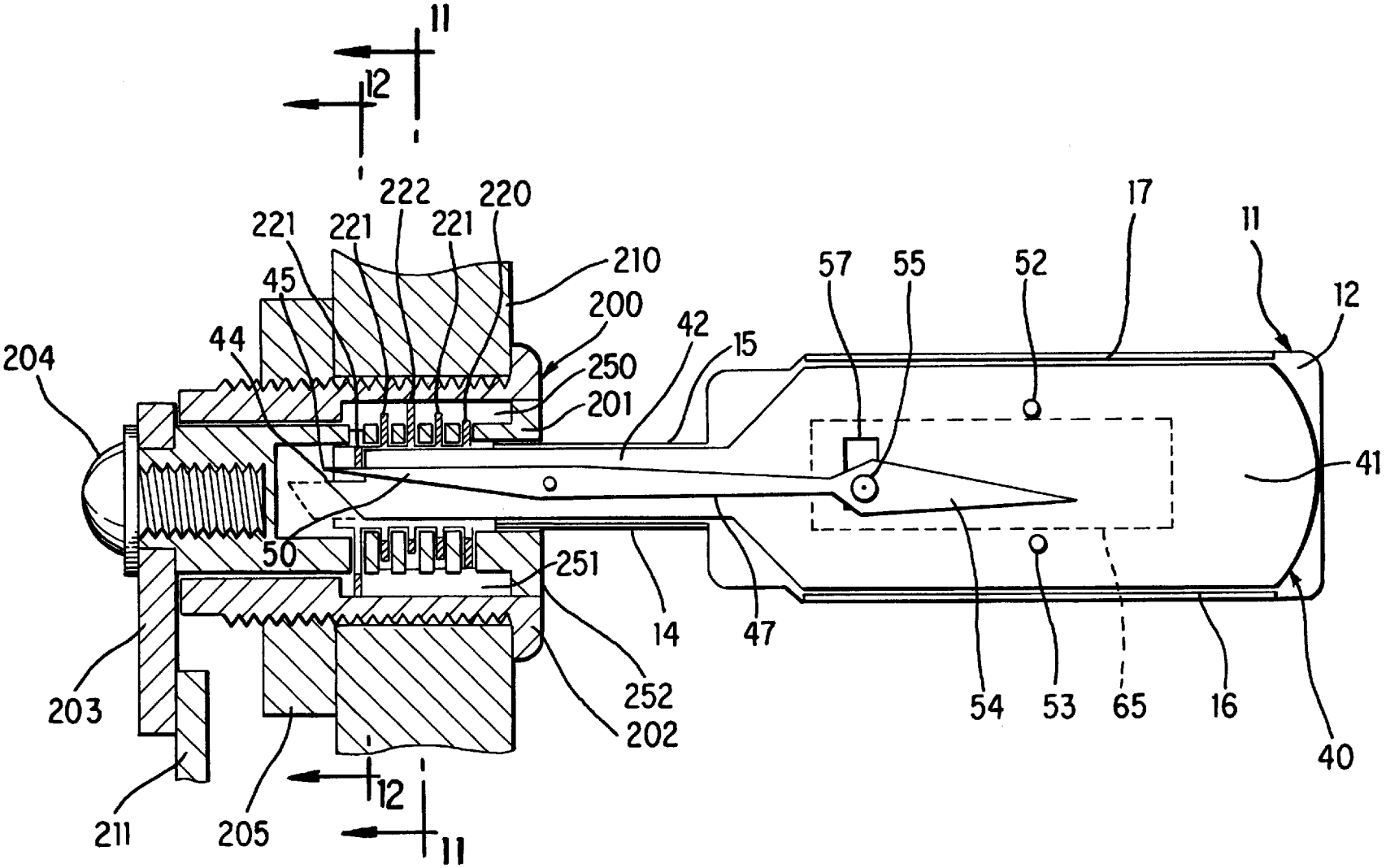

FIG. 10 is a longitudinal sectional side view of the lock shown in FIG. 1, taken along the line 10—10 of FIG. 1, and shown with the reader and guide member of the present invention inserted therein.

Figure 11:
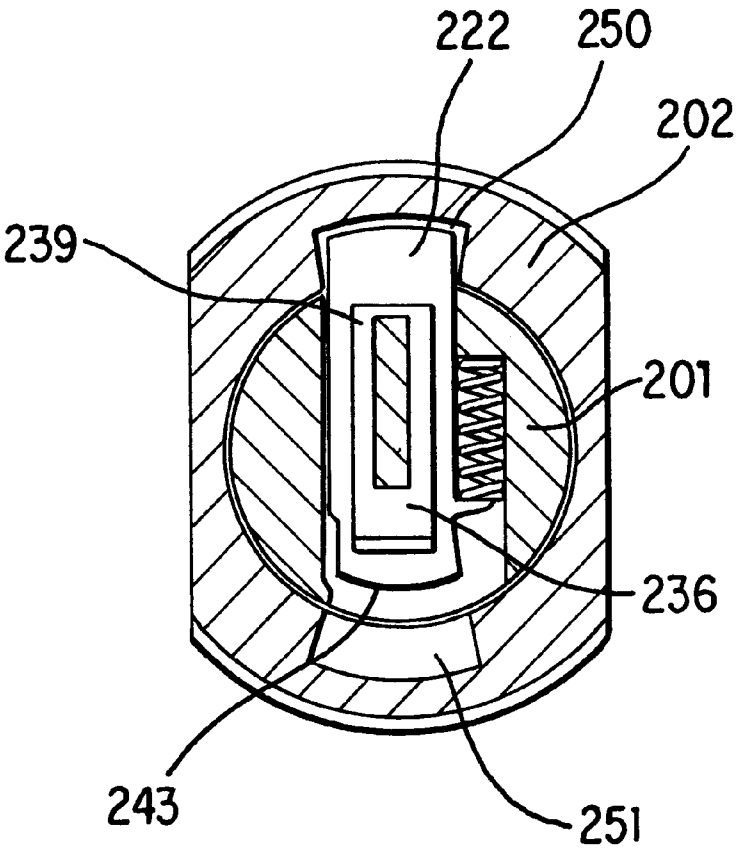

FIG. 11 is a transverse sectional view of the lock shown in FIG. 1, taken along the line 11—11 of FIG. 10, and shown with the reader of the present invention inserted therein.

Figure 12:
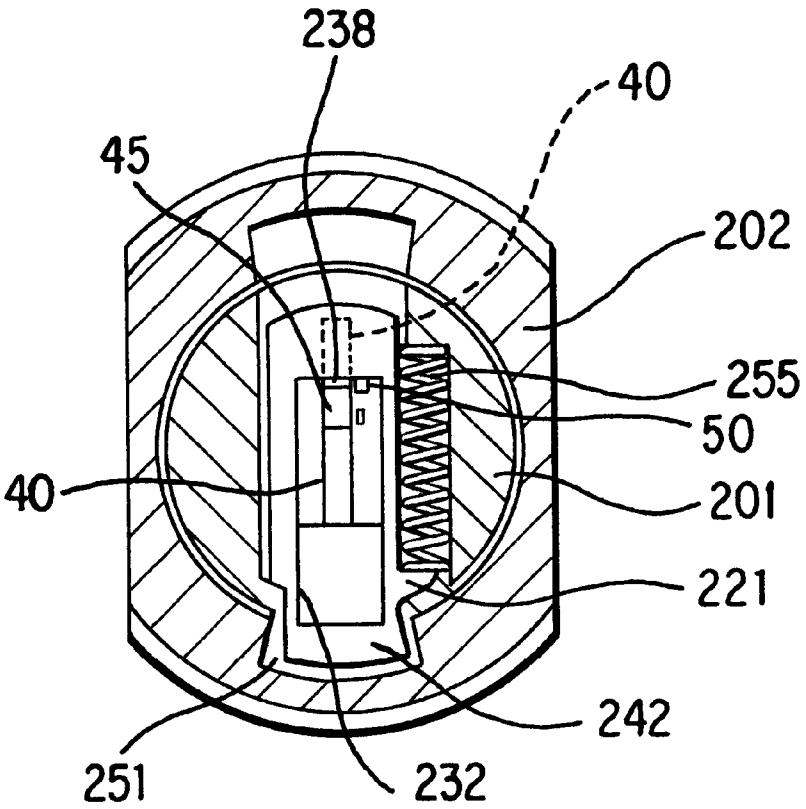

FIG. 12 is a transverse sectional view of the lock shown in FIG. 1, taken along the line 12—12 of FIG. 10, and shown with the reader of the present invention inserted therein.

Figure 13:
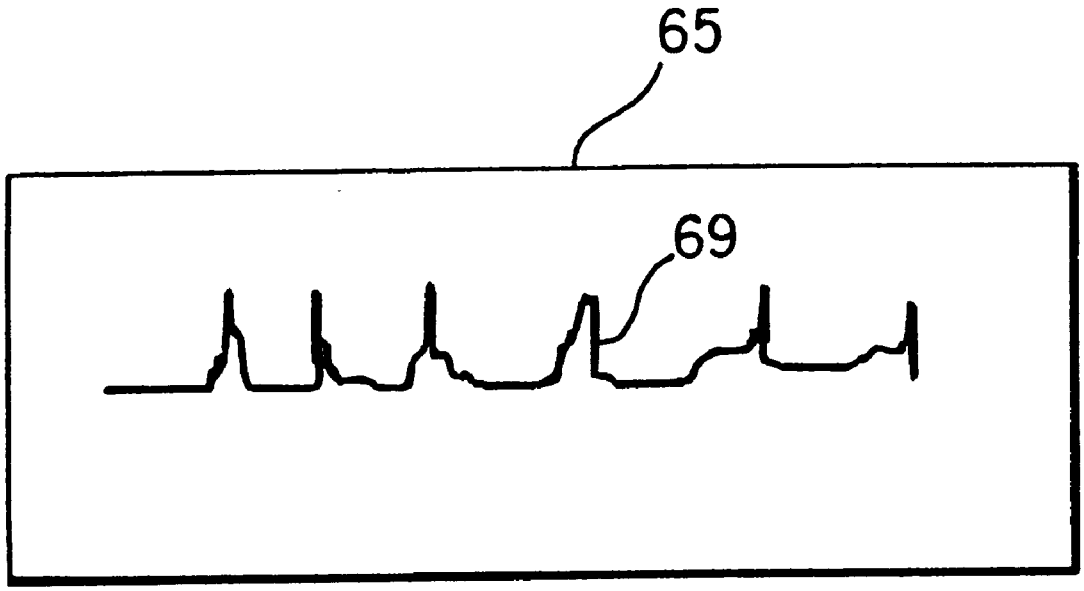

FIG. 13 is a front view of a paper strip with an image thereon corresponding to a profile of a key which can unlock the lock.

Figure 14:
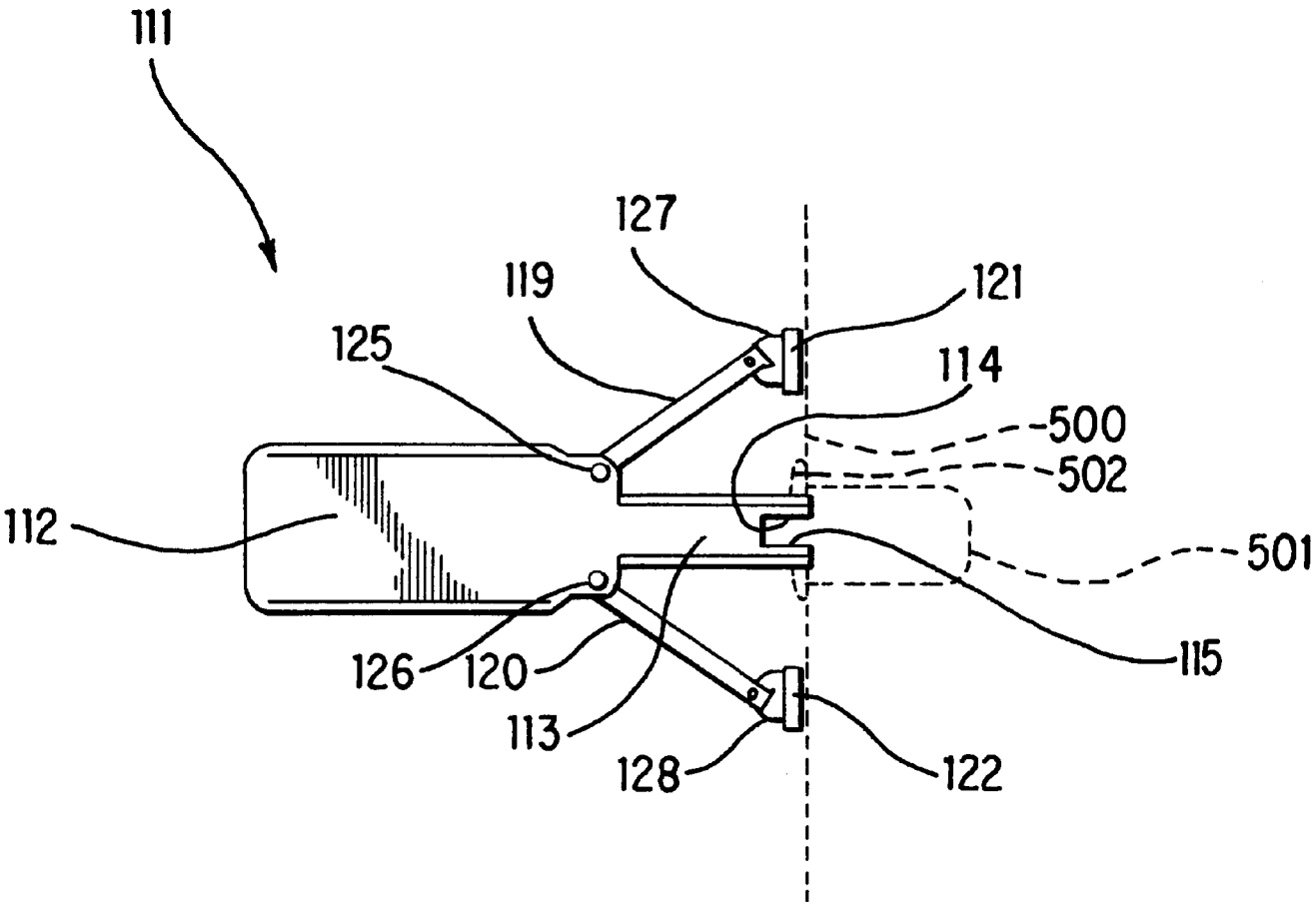

FIG. 14 is a side view of an alternate embodiment of a guide member according to the present invention, shown in use with a lock in a panel.

Figure 15:
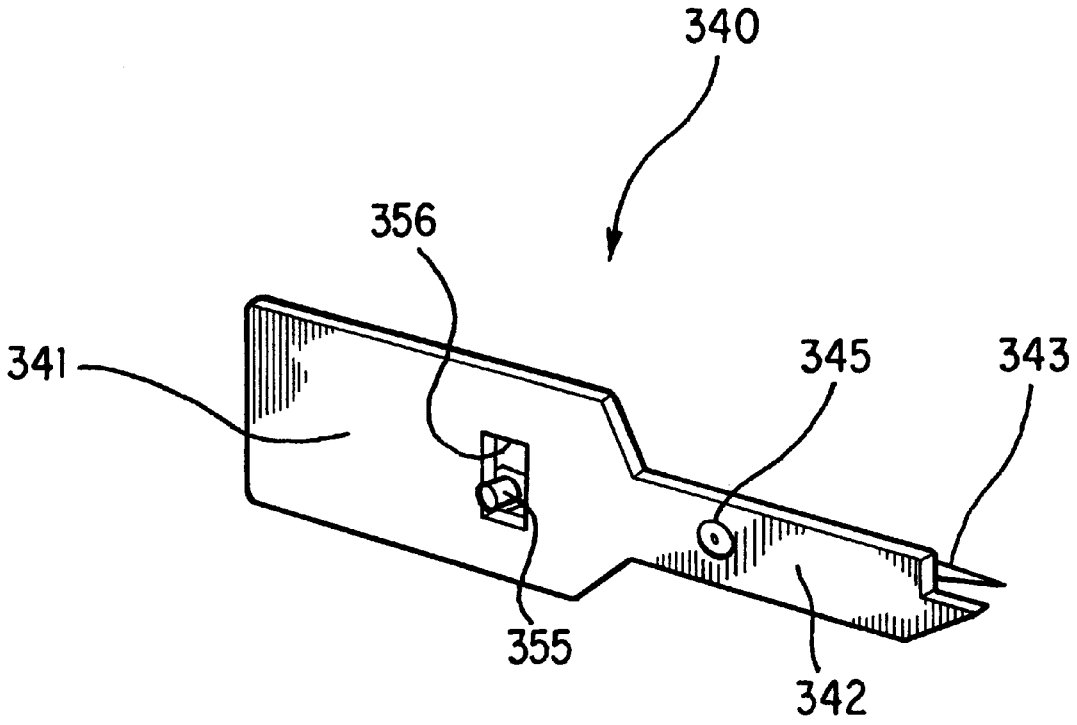

FIG. 15 is a parallel perspective view of an alternate embodiment of a reader according to the present invention.

Figure 15A:
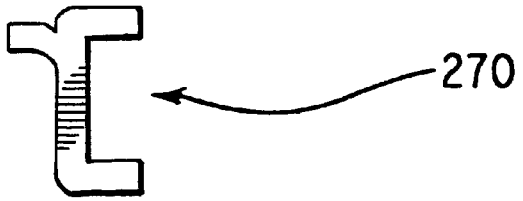

FIG. 15*a* is an alternate example of a tumbler member used in cylinder type locks.

Figure 16:
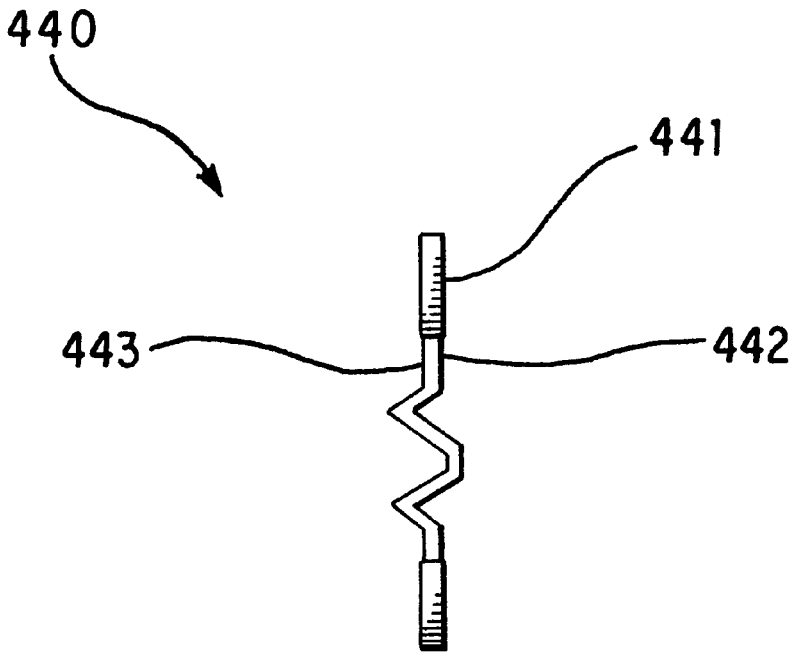

FIG. 16 is a front elevation view of yet another alternate embodiment of a reader according to the present invention.

Figure 16A:
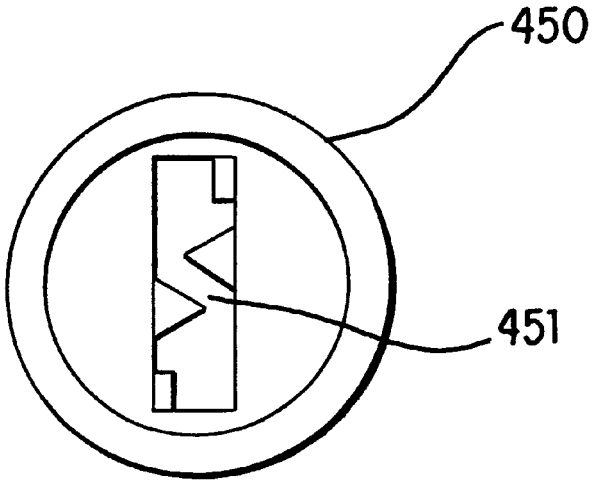

FIG. 16*a* is a front elevation view looking into a lock having an angled key slot configuration.

Figure 17:
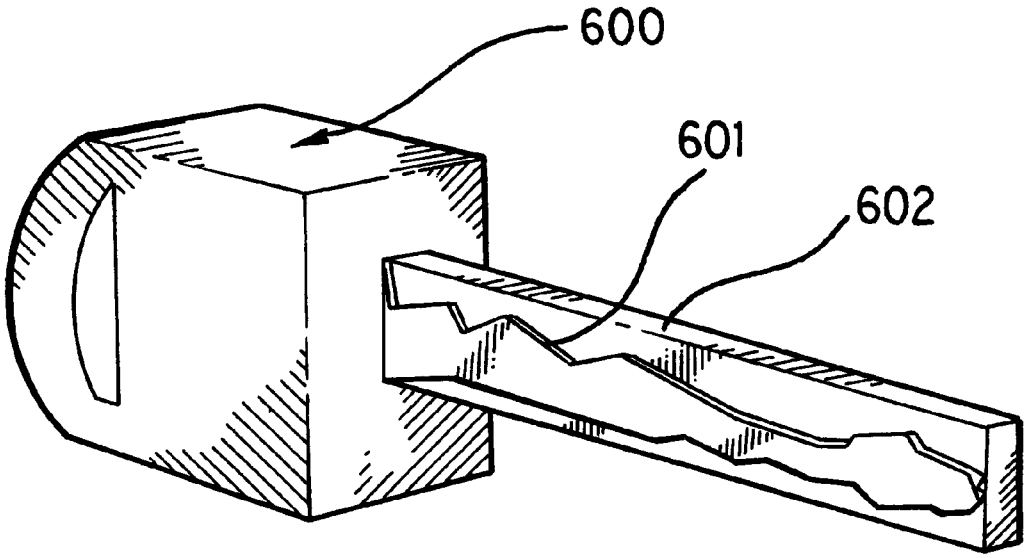

FIG. 17 is a parallel perspective view of an example of a high security key.

Figure 17A:
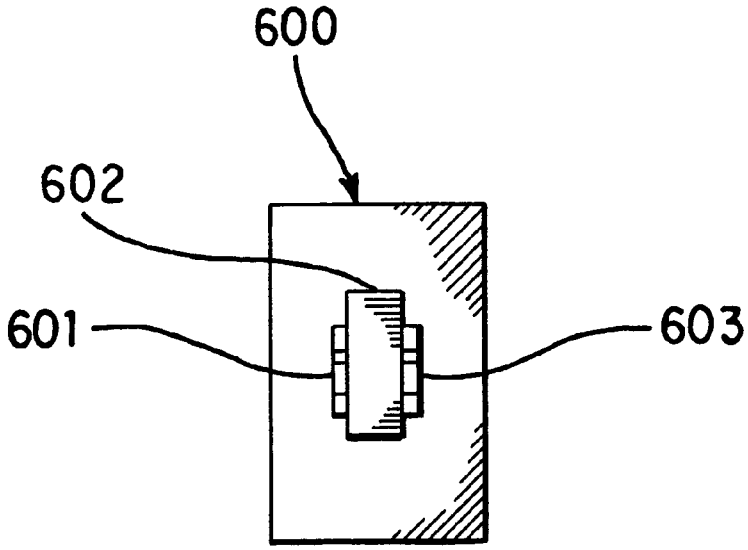

FIG. 17*a* is a front elevation view of the high security key shown in FIG. 17.

Figure 18:
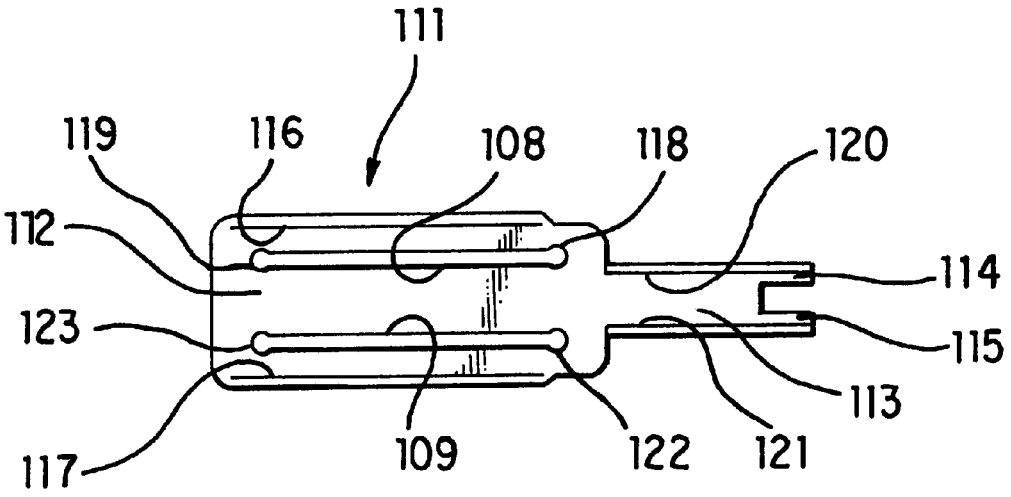

FIG. 18 is a side elevation view of yet another alternate embodiment of a guide member according to the present invention.

Figure 19:
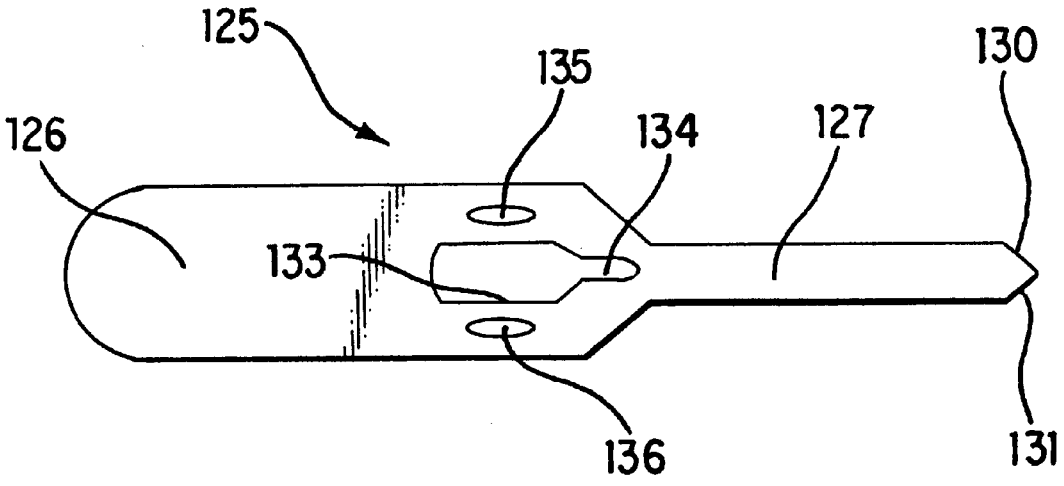

FIG. 19 is a side elevation view of an alternate embodiment of an alignment member according to the present invention.

Figure 20A:
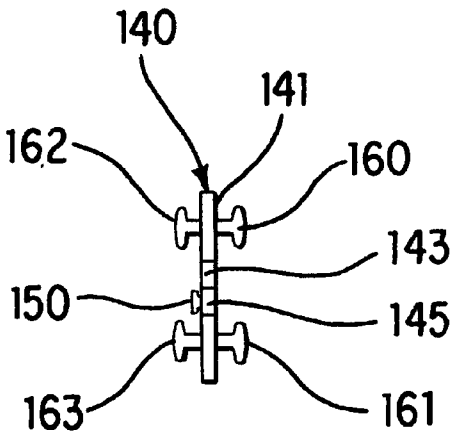
Figure 20:
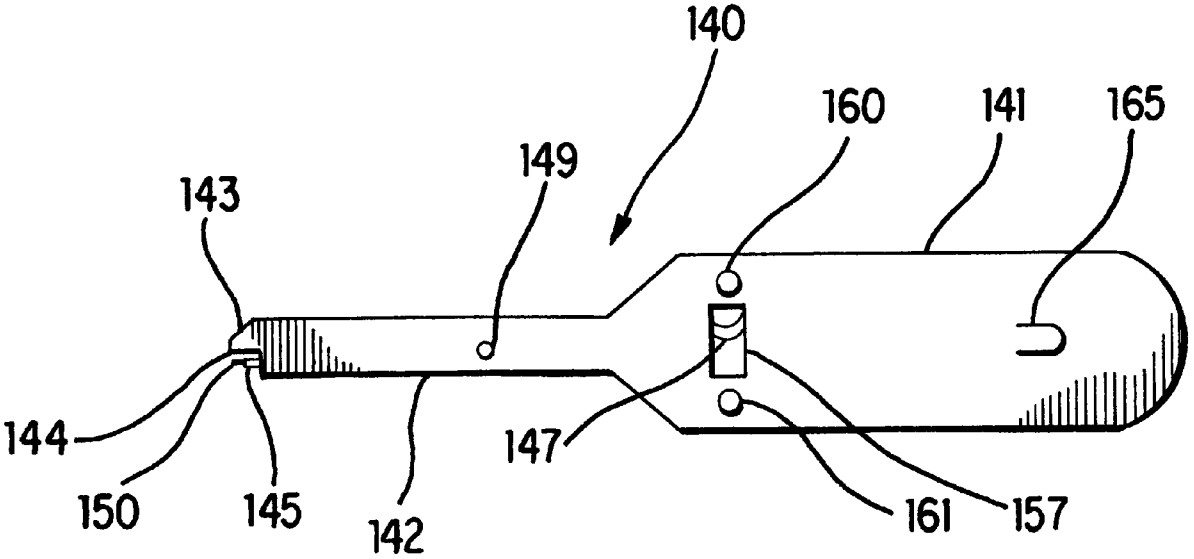

FIG. 20 is a side elevation view of yet another alternate embodiment of a reader according to the present invention.

FIG. 20*a* is a front elevation view of the reader shown in FIG. 20.

Figure 21:
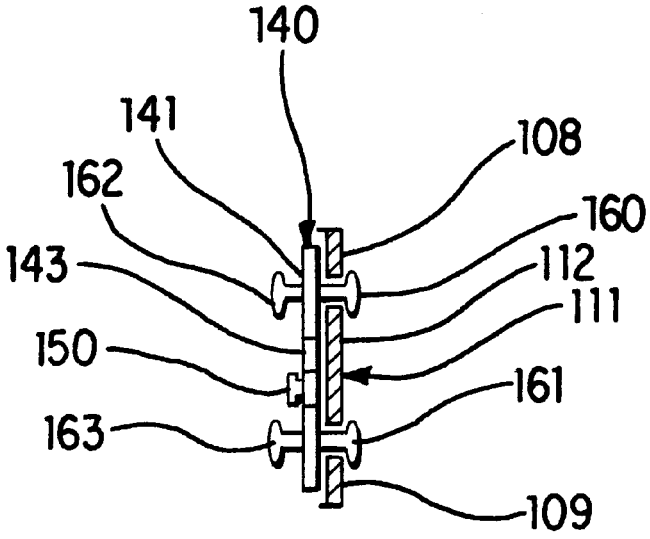

FIG. 21 is a front elevation view of the reader of FIG. 20 positioned with the guide member of FIG. 18, the guide member being shown in a partial sectional view.

Figure 22:
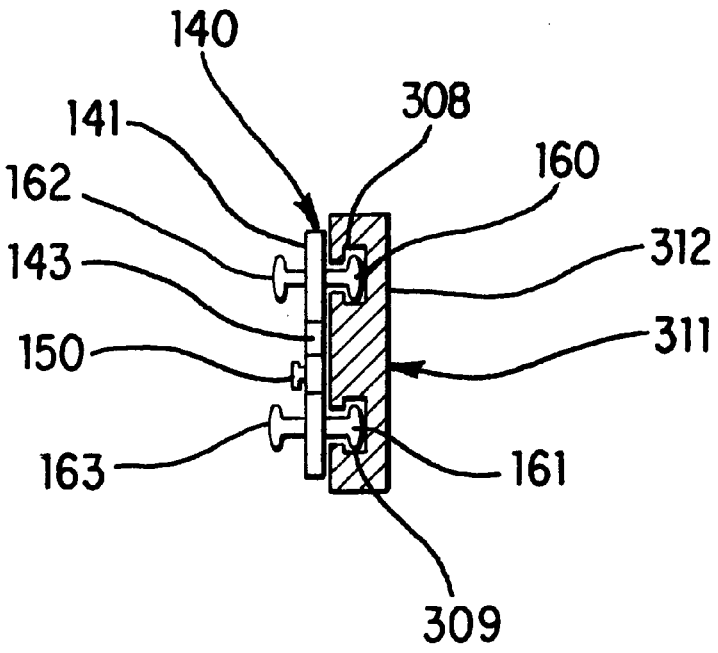

FIG. 22 is a front elevation view of the reader of FIG. 20 positioned with yet another alternate embodiment of a guide member according to the present invention, the guide member being shown in a sectional view.

DETAILED DESCRIPTION OF THE PREFERRED EMBODIMENTS

Referring to FIG. 1, a lock decoding device 10 is shown together with a lock, such as, for example, a cylinder type lock 200. The cylinder lock 200 is shown having an inner cylinder 201 which is received within an outer casing or housing 202. A pawl member 203 is shown mounted to the inner cylinder 201 and secured thereto with a securing member, such as, for example, the screw 204. The lock 200 is shown mounted to a panel 210. A mounting nut 205 is shown securing the outer housing 202 to the panel 210 by providing a clamping force to secure the flange 212 of the outer housing 202 to the panel 200. The pawl 203 is rotated by the inner cylinder 201 into and out of engagement with a keeper member or surface 211, when the lock 200 is unlocked by the properly profiled key extending through the keyhole 213 which extends axially through the inner cylinder 201, as shown in FIG. 5.

As shown in FIG. 1, a dust cover 214 is commonly featured on locks, such as, for example, the cylinder type lock 200. While the present invention is shown and described in relation to a cylinder type lock 200, it will be understood that the present invention can be used with locks other than that pictured herein consistent with the spirit and scope of the present invention.

The lock decoding device 10 of the present invention is shown in FIGS. 2 through 6, including guide means for guiding elements of the device into a keyhole 213 of a lock 200, and into the inner cylinder 201. The guide means is shown comprising a guide member 11 (FIG. 2), having a body portion 12 and an arm 13 extending therefrom. The arm 13 is provided with a pair of fingers 14, 15 extending therefrom. Track means is provided to facilitate aligning and guiding of other components of the device 10 along the guide member 11. Track means preferably are shown comprising a first pair of walls 16, 17 disposed on opposite lateral ends of the body portion 12 of the guide member 11. Preferably, the arm 13 is provided with a pair of walls 20, 21 which are disposed on opposite lateral ends thereof. The guide member 11 will be sized to fit through the keyhole of a lock and into a lock cylinder. The guide member 11 can be used with different sized locks, or can be provided in different sizes to be used with locks of all sizes. Referring to FIG. 2*a*, an alternate embodiment of a guide member 19 is shown having an arm portion without a notch and without the fingers of the guide member 11.

Reference now being made to FIG. 3, where an alignment member 25 is shown. The alignment member 25 is shown having a body portion 26 at one end thereof with an elongated portion 27 extending from the body portion 26. The elongated portion 27 preferably has a terminal sloping portion, such as for example, the sloped edges 30, 31 provided at the end of the elongated portion 27. The alignment member 25 further includes a first aligning slot or cut out 32 and a second aligning slot or cut out 33. Preferably, the alignment member 25 is provided to be received within the track means of the guide member 11, when the device 10 is used. The second aligning slot 33 further includes a narrow portion 34 at the leading edge thereof.

Reading means is also provided to read the position of the pins or wafers of a lock. Reading means is shown in FIG. 4 comprising a reading member 40. The reading member 40 preferably has a body portion 41 at one end thereof and an arm 42 extending outwardly from the body portion. The arm 42 is shown having an angled edge portion 43 and a notched edge. The notched edge preferably is provided comprising a horizontal edge 44 and a vertical edge 45 connected at right angles to one another as shown in FIG. 4. The reading means includes responder means which responds to the interior component configuration or profile of a lock. The responder means is shown comprising a pivotable needle member 47, which is pivotally connected to the reader arm 42 by a suitable fastening member, such as, for example, the connecting pin 49. Preferably, a bearing 48 (FIG. 6) can be used to facilitate the pivot connection between the reader arm 42 and the needle member 47. For example, the bearing 48 can be provided to be received, entirely, or partly, within the thickness of the reader arm 42 to facilitate pivoting of the needle 47 relative to the reader arm 42 and body 41. Preferably, the bearing 48 and connecting pin 49 will be disposed within the thickness, or as closely thereto, to permit the insertion and operation of the reader arm 42 into a lock keyway.

The needle member 47 is shown including a first end 50 which is provided to extend beyond the vertical wall 45 of the reader arm 42. A second needle member end, includes the writing end 54. The writing end of the needle member 47 preferably can have a recording member, such as, for example, the stylus 55, and preferably has an arrow 46 or pointed configuration.

As shown in this embodiment, the stylus 55 is provided with an ink cartridge having a writing tip at one end thereof for producing an image on a recording medium. The writing end 54 is shown comprising an arrow configuration including holding means for holding a recording member, such as, for example, the stylus 55 therein. A through slot 57 is disposed in the reader body 41 for permitting the stylus to communicate with a recording medium, which is preferably carried on the guide member 11. The through slot 57 is shown having a rectangular configuration. The needle member or responder 47 is displaced as it engages the various lock elements, such as, for example, pins and/or wafers, and responds by causing the stylus 55 to undergo a corresponding displacement.

The needle member or responder 47 further can include a spring member disposed preferably at the pivot point thereof. As shown in the top view of FIG. 6, the spring means is shown comprising a coil spring member 60 having a first spring leg 61 which is connected to the reader arm portion 42 and a second spring leg 62 connected to the needle member or responder 47, the spring legs 61 and 62 being connected by a coil 63 of the spring member 60. The spring member 60 is provided to regulate the movement of the needle member or responder 47, and provides a biasing force or resistance to the movement of the needle member 47. Preferably, the spring 60 loads the needle member or responder 47 to its starting or baseline position, from which the needle member 47 is displaced by contact with a pin or wafer of a lock.

Storing means is provided to store the profile information recorded with the responder 47. Preferably, as shown in FIGS. 5*a*, 6 and 10, the recording means comprises a medium which can record the movement of the stylus 55 thereon. The recording means is provided comprising a paper strip 65. Holding means is provided to hold the paper strip 65 on the guide member 11. Preferably, the holding means comprises a releasable adhesive provided on the back of the paper strip 65. The paper strip 65 is placed on the guide member 11, and a reading is taken, after which, the paper strip 65 can be replaced by a fresh strip for a subsequent reading.

Alignment means is provided on the reader 40 to facilitate alignment of the reader 40 with the alignment member 25. The reader alignment means is shown comprising a pair of aligning or guide pins 52, 53 which extend transversely outwardly from the reader body 41.

Reference now being made to FIG. 10, wherein the device 10 of the present invention is being used in connection with a lock 200. The reader 40 is shown inserted into a lock cylinder 201. The lock 200 is shown to demonstrate the operation of the present device 10. The lock 200 includes wafer members deployed therein. Five wafer members 220, 221, 222, 223, 224 and 225, as shown in FIGS. 7, 8 and 9, are provided for use within the lock 200. As shown in FIG. 7, the first wafer 220 defines an opening 230 having a vertical height represented by the arrow "a", and being located a distance 231 away from its upper end, the distance being represented by arrows "c" and "d". A second wafer 221 is shown in FIG. 8, which is provided with a greater distance 233 from its upper end and the opening 232 provided therein. FIG. 9 shows yet another wafer 222, wherein the distance 235 from the top of the wafer 222 to the wafer opening 236 is even greater than those 220 and 221. In a key cut to operate a lock, such as, for example, the cylinder lock 200, there is for a position in which a wafer 220 is present, a notch of a particular depth, which can be referred to as a number one cut, which is necessary to raise the wafer 220 to a position in which its ends are aligned with the surface of the lock inner cylinder 201. For example, if a key is inserted into a lock 200 such that any notch other than a number one cut is located within the opening 230, then the first wafer 220 would extend into one of the grooves 250, 251 (see FIGS. 10, 11 and 12) defined by the outer casing 202 of the lock 200, within which the cylinder 201 is located. The second wafer 221, requires a cut or notch of greater depth, relative to that for the wafer 220, in any position on a key corresponding to where the wafer 221 is located, because of the greater distance 233 (FIG. 8).

As shown in FIG. 10, each wafer 220, 221 and 222, is located within a respective position of the lock 200 commonly referred to by numbering beginning nearest the face 252 of the inner cylinder 201. Because the wafers 220, 221 and 222, as shown, for example, with this type of lock 200, are identically sized and interchangeable, except for the location of their respective openings, 230, 232 and 236, and the corresponding distances 231, 233, and 235, the bottom end of each wafer is located within the groove 251 of the casing 202, preventing the cylinder 201 from turning relative to the casing 202, unless a key having the correct profile is inserted in the lock 200. Because each wafer must move the same distance from a locked position to an unlocked position within the cylinder 201, the different distances 231, 233, and 235 result in the upper interior surface 237 of the opening 230, the upper interior surface 238 of the opening 232, and the upper interior surface 239 of the opening 236 being at different heights when the respective wafers 220, 221 and 222, are in their locking positions. In order to determine the proper depth of cut required on a key at each wafer position, in order for the key to operate to open a lock, it is sufficient to know the position of the upper interior surface of the opening of each wafer when that wafer is in a locking position with its bottom end, see generally 241, 242 and 243, in a groove 251. As shown in FIG. 11, the bottom end 241 of the first wafer 220, is disposed in the groove 251.

The operation of the device 10 is generally carried out by first inserting the guide member 11 into the lock 200, as shown in FIG. 1. The insertion of the guide 11 generally moves the dust cover 214 out of the way of the lock opening 213. The guide member 11, is preferably preloaded with recording medium, such as, for example, the adhesive backed paper strip 65 shown in FIG. 7. Alternately, the paper strip 65 can also be installed on the guide member at a later time. The guide member 11 remains in the lock and the leading end of the alignment member 25, with the sloped edge portions 30, 31, is inserted into the lock cylinder. Alternately, the alignment member 25 can be placed on the guide member 11 and the members 25 and 11 inserted into the lock cylinder at the same time. The insertion of the alignment member 25 acts to raise the wafer members 220, 221 and 223. The leading end of the alignment member 25, comprising the sloped edge portions 30, 31, is similar to the front of a key which will fit the lock. This causes each wafer to be pushed upward when the alignment member enters the lock, so that the upper end of each wafer extends upwardly into the groove 250, by contact of the sloped edge of the alignment member 25 with the upper interior surfaces, 237, 238, 239 of each wafer. Preferably, the alignment member 25 will be provided having a thickness which will enable it to operate within the lock 200. Since different lock applications will require different sized keys, the alignment member can be provided having different thicknesses and sizes.

The reader 40 is then inserted within the lock cylinder and is aligned with the guide member 11. Preferably, the track means of the guide member 11 accommodates the reader 40. For example, the reader body 41 is preferably aligned with the walls 16, 17 of the guide member 11 and the reader arm 42 aligned with the walls 20, 21 of the guide member arm 13. The recording member, such as, for example, the ink stylus or pen 55 is then installed on the reader 40 by inserting it into the reader 40 so that it is retained therein, as shown in FIGS. 4 and 10.

Once the reader 40 is situated within the lock, the alignment member 25 is then withdrawn. The reader 40 is then slowly withdrawn from the lock cylinder 201. As the reader 40 is withdrawn, the responder 50 engages the upper surface of the first wafer 220 and the wafer 220 causes the responder to deflect downwardly against the spring bias of the spring member 60. The downward deflection is then picked up by the recording end 54 of the responder 47 causing the stylus to be moved in relation to the paper 65. The downward deflection is recorded and an image corresponding to the location and size of the deflection, is then transferred onto the paper 65 by the stylus 55. The tip of the responder follows the profile of the spaces and other wafers disposed within the lock cylinder to complete a corresponding profile image on the paper 65 with the stylus movement.

Referring to FIG. 10, the reader 40 is shown in dashed-line representation in its fully inserted position, from which it has been withdrawn to its full-line position, until the notched edge, comprising edges 44 and 45, of the reader 40 has been aligned with the wafer position five of the cylinder 201. The wafer 221 occupying position five of the lock 200 is located in the notched recess defined by walls 44 and 45 of the reader 40 and has been urged into its locking position by its associated spring member 255, shown in FIG. 11. As shown, for example, in connection with the lock 200, the bottom portion 243 of the wafer 221 is positioned within the groove 251 at the bottom of the casing or housing 202. As a result, the upper interior surface 238 of the wafer 221 is positioned to be read by the responder 47 of the reader 40.

Preferably, when the reader 40 is completely withdrawn and all of the wafer positions have been ascertained, the process is then repeated for the other side, or bottom, of the lock. This time, the reader 40 is turned upside down in relation to the first reading. The steps are performed again to obtain the profile relative to the bottom of the lock. The profiles obtained, profile (top) and profile (bottom) are then superimposed over one another to for the lock profile. With the ascertained knowledge of the lock profile, a key can now be made which will unlock the lock.

Referring to FIGS. 5 and 5*a*, decoding means is provided to facilitate decoding the signal or recorded image drawn by the stylus 55. Preferably, the decoding means comprises a transparent element having a grid thereon for comparing the relative positions of the image made by the stylus on the paper. For example, as shown in FIGS. 5 and 5*a*, the decoder can, comprise a transparent plastic member 75 which is provided with a series of horizontal lines 76, 77, 78, 79 and 80 thereon. Preferably, the lines can be set as predetermined distances which enables a reading of the cuts necessary for the key with the proper profile to be made therefrom. The decoder 75 further preferably can be provided with a retaining means to be retained within the body portion 12 of the guide member 11 once a reading has been made. This permits the decoder 75 to be placed over the recording medium, such as, for example, the paper 65, as shown in FIG. 5*a*. The guide member 11 preferably, further includes means which defines the location of where a paper 65 can be placed thereon. However, it will be understood that even if the paper 65 is not centrally aligned, as long as the stylus 55 is able to write to the paper 65 to record the entire profile, the decoder 75 can be used to interpret the results.

Furthermore, the optical image of the paper 65 can also be further processed. For example, the optical image can be read with scanning means and that information stored and used to cut or form a key having the corresponding correct profile. Furthermore, the recording medium can include electronic recording media, which can record the profile, and store the profile, and be transferred.

Alternate decoder means is shown provided on the body portion 41 of the reader 40, comprising a series of spaced apart lines, 90, 91, 92, 93, 94, 95 and 96. Preferably, the lines 90, 91, 92, 93, 94, 95 and 96 are radially spaced apart to correspond to an arc of movement or displacement of the needle end 50 as it engages the wafers and interior of the lock cylinder. The decoder means enables the recording end 54 of the responder 47 to identify the position of the wafers relative to one another by the position of the lines 90, 91, 92, 93, 94, 95 and 96 to which the arrow 54 points when a wafer or pin is engaged by the needle end 50. The decoder means can be provided in addition to, or alternately in place of the decoder member 75 shown in FIGS. 5 and 5*a*.

Referring to FIG. 14, an alternate embodiment of a guide member 111 according to the present invention is shown, having a body portion 112, an arm 113 extending therefrom, and fingers 114, 115 extending from the arm. Alignment walls are also provided, as shown and described above in connection with the guide member 11. The guide member 111 is provided with holding means for holding the guide member 111 in position within the lock while the alignment member 25 and reader 40 are used therewith. Preferably, the holding means comprises a pair of stabilizing members 119, 120 which are pivotally connected to the guide member 111 at one end thereof, and having gripping means disposed on the other end thereof. Preferably, the gripping means can comprise magnetic means, including for example, a magnetic foot 121, 122 provided on each leg 119, 120, respectively, to attach to an object to which the lock is attached, such as, for example, a door of a car. The gripping means can also comprise suctioning means, such as a suction cup which can attach to the panel of the lock installation to facilitate holding of the guide member 111 for decoding of the lock. The means pivotally connecting the legs 119, 120 to the body 112 of the guide member 111 can, for example, comprise any suitable fastening members, such as, for example, the rivets, 125, 126, shown in FIG. 14. The magnetic feet 121, 122 are preferably pivotally maintained on each respective leg 119, 120, by a suitable connecting member, which is shown comprising connectors 127, 128 which connect the magnetic feet 121, 122 with the legs 119, 120, respectively. The magnetic feet 121, 122 are shown attached to a panel 500, which has a lock 501, including a lock flange 502, installed thereon. The guide member fingers 114, 115 extend into the lock 501 as the guide member 111 is held in place with the legs 119, 120 and magnetic members 121, 122. This enables the alignment member to then be inserted, freeing the operator's hands for other tasks.

In an alternate embodiment, not shown, the magnetic feet can be fixedly attached to a leg, and provided having a series of angled surfaces for contact with a panel in which the lock is installed.

As shown in FIG. 17, the profile of a high security key 600 has a first cut portion 601 and a wall portion 602 separating a second cut portion 603 provided on the opposite side of the wall portion 602. The reader can therefore be provided having a thickness which corresponds to the key thickness in order to accommodate the wall portion 602 of such locks. A reader 340 is shown in FIGS. 15, provided in an alternate embodiment for use in decoding high security type locks. FIG. 15*a* shows an example of a tumbler 270 of the type which may be found in a high security type lock. The reader 340 is shown having a body portion 341 with an arm portion 342 extending therefrom. A responder,343 is pivotally mounted to the reader 340, preferably, as shown having a bearing 345 disposed within the reader arm 342 to facilitate movement of the responder 343. The reader 340 is similar to the reader 40 described herein, with the exception of being provided having a thicker configuration. A stylus 355 is provided to extend through the body opening 356 of the reader 340 to communicate with a recording medium, such as, for example, the paper 65 placed on the guide member 11, described above. The alignment slide can also be provided having a thicker configuration, entirely, or in part. The guide member can also be provided having wall portions which extend further from the guide member body portion to facilitate alignment of the reader 340, or alternately, or additionally, can be provided with a thicker configuration.

Other types of locks, such as for example, the lock 450 of FIG. 16*a*, include those wherein the key slot has a barrier therein, such as, for example, the angularly configured key slot interior 451. A further alternate embodiment of a reader 440 according to the present invention is shown in FIG. 16 having a body 441 with an arm portion 442 extending therefrom which has an angular configuration for facilitating entry of the reader arm 442 into the interior of a lock cylinder. The responder 443 is provided to read the position of the tumbler members, such as, for example, the pins or wafers, disposed therein.

An alternate embodiment of a lock decoding device 100, according to the present invention, is shown in FIGS. 18 through 21. The decoding device 100 includes guide means for guiding the reader 140 (FIGS. 20 and 20*a*) relative to the guide member 111 (FIG. 18) to facilitate obtaining a profile of the lock being decoded. The guide member 111 is shown having a body portion 112 and an arm 113 extending therefrom. The arm 113 may also be provided, optionally, with a pair of fingers, 114, 115 extending therefrom. Guide means is shown comprising track means including a pair of slots 108, 109 disposed in the body portion 112 of the guide member 111. As shown in FIG. 18, the guide slots 108, 109 are each provided, respectively, with a receiving zone, comprising an enlarged end portion, such as the enlarged slots 118, 119 provided on the upper guide slot 108, and the enlarged end portions 122, 123 provided at the ends of the lower guide slot 109.

Referring to FIG. 19, an alternate embodiment of an alignment member 125 is shown according to the present invention. The alignment member 125 includes a body portion 126 with an arm 127 extending therefrom. The arm 127 is shown comprising a terminal portion including a first slanted edge 130 and a second slanted edge 131. The alignment member 125 further includes a central slot 133 having a narrow portion 134 at the leading edge thereof. Alignment slots 135, 136 are disposed on each side of the central slot 133. As shown in FIGS. 20 and 20*a*, the reader 140 is provided with a first pair of alignment pins 160, 161 extending outwardly from the body portion 141 on one side thereof and a second pair of alignment pins 162, 163 extending outwardly from the opposite body portion side.

Guard means, preferably, is further provided to prevent a user from inadvertently contacting the pivotally mounted needle member 147 when the device 100 is being used. The guard means is shown comprising a raised portion or boss member 165 provided on the reader body 141. In FIG. 20, the reader 141 is viewed from the side opposite that of the needle arm side. The needle arm 147 can be seen extending beyond the vertical edge 145 which, together with the horizontal wall portion 144, forms a notched end portion. The angled wall 143 is provided on the opposite side of the notched portion of the reader arm 142. The reader 140 functions similarly, as the reader 40 described above, and includes a pivot member such as, for example, a connecting pin 149 for pivotally connecting the needle member 147 to the reader arm 142. The guide member 111 is displayed in FIG. 21 in a cross-sectional view to show the receipt of the alignment pins 160, 161 in the alignment slots, respectively, 108, 109. The alignment means facilitates positioning of the reader member 140 with respect to the guide member 111 when the reader 140 is withdrawn from a lock and is moved relative to the guide member 111. This ensures that the image recorded on the recording medium, as described above, is evenly represented. While not shown in connection with the embodiments relating to FIGS. 1–17*a*, it will be understood that some or all of the features described herein with respect to the embodiments described and shown in FIGS. 18–22 can also be utilized therewith. For example, the reader 40 can include guard means.

While the alignment means is shown in the series of FIGS. 18 through 21 comprising alignment pins 160, 161, and 162, 163, it will be understood that the walls shown comprising the guide means in the guide member 11 of FIG. 2 can also preferably be provided with the alternate embodiments shown in FIGS. 18 through 21. Similarly, the slots 135, 136 of the alignment member 125 are provided to receive a pair of the alignment pins 160, 161, and 162, 163, respectively when the reader is positioned over the alignment member 125 and guide member 111. For example, the elongated configuration of the slots 135, 136 enables the alignment member 125 to be withdrawn and maintained at a distance relative to the reader 125 so that the reader needle 147 (and not the leading edge 130, 131 of the alignment member 125) will contact the wafers or pins of the lock cylinder to be decoded. Preferably, the alignment member 125 is removed once the reader 140 is inserted into the lock cylinder.

The reader 140, can be inverted so that the needle member 147 will be positioned to read the lower portion of the wafers or pins of the lock cylinder. When the reader 140 is inverted, the alignment pins 162, 163 will be received in the guide slots 108, 109.

The alternate embodiments shown in FIGS. 18 through 21 are provided to function in the manner described above with the embodiments shown in FIGS. 1 through 17*a*, to record images and decode a lock. In addition, although not shown with respect to the alternate embodiments, the members may be provided having a thicker, or of alternate, configurations consistent with the present invention.

Although the slots 108, 109 are shown as apertures, it will be further understood that the slots can, in an alternate guide member embodiment 311, comprise grooves 308, 309 which receive the ends of pins, such as those 160, 161, and permit the pins 161, 162 to slide there along. An example of this alternate embodiment is shown in FIG. 22.

While a specific orientation of the reader, for example, may be shown in a drawing, it will be understood that the reader, as well as other elements of the invention, can be provided having a reverse orientation. For example, the responder could be on either side of the reader body, the reader notch section could be provided inverted, or can be turned upside down, relative to the positions shown herein, depending on the lock mechanism which is being decoded by the present invention. The components described herein can also be sized for application to locks of different dimensions. These and other modifications and advantages of the present invention can be made consistent with the spirit and scope of the invention as disclosed in the Summary of the Invention, the Brief Description of the Drawing Figures, the Detailed Description of the Preferred Embodiments and the appended claims.

What is claimed is:

1. An apparatus for decoding a lock, comprising:

a) a guide member selectively positionable in the keyhole of a lock;

b) an alignment member for insertion into a keyhole of a lock to move lock tumblers against their normally inwardly spring biased positions;

c) a reader having an arm which is pivotally connected thereto, wherein said reader is adapted for insertion into a keyhole of a lock;

d) recording means positionable on the guide member and being provided to record the position of said pivotally connected arm of said reader relative to a lock tumbler;

e) wherein said reader is movable relative to said guide member from a first position through a range of positions; and f) wherein said recording means records the position of said reader arm relative to said guide member and relative to said lock tumbler; and g) a recording member comprising a stylus being carried by the arm of the reader and movable therewith to produce an image corresponding to the profile of a key on said recording means.

2. An apparatus for decoding a lock, comprising:

a) alignment member for moving the lock tumblers against their normally inwardly spring biased positions;

b) reader means having an arm which is pivotally connected thereto;

c) recording means provided to record the position of said pivotally connected arm of said reader means; and d) guide means for guiding the alignment means and the reader means within the lock, said recording means being carried on said guide means;

e) wherein said reader means is movable relative to said guide means from a first position through a range of positions corresponding to a keyhole of a lock to be decoded; and f) wherein the reader means is provided having a body portion having an elongated portion extending therefrom, and wherein the reader means is provided having a cross-sectional thickness corresponding to the keyhole of the lock to facilitate reading of the tumbler positions thereby.

3. The lock decoding apparatus of claim 2, wherein said alignment member further includes an arm having a sloped edge portion at one end thereof.

4. The lock decoding apparatus of claim 3, wherein said reader means includes a notched portion at one end thereof, and wherein said pivotally connected arm of said reader means has a first portion extending from the pivot point to the notched portion of the reader means and a second portion extending from the pivot point in the opposite direction of said first portion; wherein said first portion of said reader arm when inserted in a lock, engages a tumbler member and is deflected thereby, and wherein the deflection of said first portion deflects said second portion a corresponding unit relative to said tumbler position.

5. The lock decoding apparatus of claim 2, wherein the guide means further includes holding means for holding the guide member to a surface.

6. The lock decoding apparatus of claim 5, wherein the holding means comprises magnetic means.

7. The lock decoding apparatus of claim 6, wherein the holding means further comprises a pair of movable leg members, each being connected to the guide means at one end thereof and having a foot at the other end thereof for selective attachment to a panel while the guide means is in use.

8. The apparatus of claim 2, wherein said guide means comprises a guide member having a pair of tracks disposed therein, and wherein said reader means includes a pair of outwardly extending pins for receipt within said tracks and movement there along when said reader means is moved relative to said guide member.

9. The lock decoding apparatus of claim 8, wherein said guide means further comprise wall portions provided on the guide member for facilitating guiding of the reader.

10. The lock decoding device of claim 2, wherein said reader means is provided with a pair of guide pins disposed on at least one side thereof, said guide means having a body portion with a pair of parallel slots disposed in said body portion, said slots having a receiving zone comprising an enlarged portion of each said slot for receipt of a guide pin of the reader means therein, said guide pins being provided to be moved along said slots when said reader means is moved relative to said guide means.

11. An apparatus for decoding a lock, comprising:

a) a guide member having a body portion with an arm extending outwardly therefrom for insertion within a lock;

b) an alignment member having a body portion and an elongated portion extending from the body portion at one end thereof and having a sloped edge portion at the other end thereof for insertion into a lock;

c) a reader having a body portion with an arm extending therefrom, the reader further including a needle member which is pivotally connected thereto for movement about its pivot axis, there being control means to control the pivot movement of the needle member, said control means comprising a spring member of which one end is connected to the reader body and the other end is connected to the needle member, said spring biasing the needle member into a first position wherein the needle member is aligned with the top portion of said arm, and being provided to be acted upon by a tumbler member when engaged by the needle member to cause a deflection of the needle member against the bias of the spring;

d) recording means provided to record the position of said pivotally connected arm of said reader, said recording means comprising stylus means disposed in the needle member of the reader; and e) recording medium for storing an image transcribed by the recording means corresponding to a profile of a key, said recording medium comprising a paper disposed on the guide member;

f) wherein said reader further includes a slot disposed therein, and wherein said stylus extends through said slot to communicate with the recording medium carried on said guide member.

12. A kit for decoding a lock comprising:

a) a guide member;

b) an alignment member for insertion into a key slot of a lock to move lock tumblers against their normally inwardly spring biased positions;

c) a reader having an arm which is pivotally connected thereto;

d) wherein said reader is movable relative to said guide member from a first position through a range of positions corresponding to the tumbler positions of a lock; and e) recording means associated with said guide member and being provided to record the position of said pivotally connected arm of said reader relative to a lock tumbler through said range of positions;

f) wherein said recording means comprises a recordable medium, and wherein said kit further comprises a stylus carried by said reader arm for producing an image on said recordable medium.

13. An apparatus for decoding a lock, comprising:

a) a guide member selectively positionable in a keyhole of a lock;

b) an alignment member for insertion into a keyhole of a lock to move lock tumblers against their normally inwardly spring biased positions;

c) a reader having an arm which is pivotally connected thereto, wherein said reader is adapted for insertion into a keyhole of a lock;

d) recording means provided to record the position of said pivotally connected arm of said reader relative to a lock tumbler;

e) wherein said reader is movable relative to said guide member from a first position through a range of positions; and f) wherein said recording means records the position of said reader arm to record the profile of a key corresponding to a lock being decoded;

g) wherein said recording means comprises a recordable medium and a recording member comprising a stylus carried by said reader arm for producing an image on said recordable medium.

* * * * *